United States Patent [19]

Crawford et al.

[11] 4,193,851

[45] Mar. 18, 1980

[54] SILICA GELS AND THEIR FORMATION BY ELECTROLYSIS OF SILICATE SOLUTIONS

[75] Inventors: Roger A. Crawford, Wadsworth; Howard H. Hoekje, Corpus Christi, both of Tex.

[73] Assignee: PPG Industries, Inc., Pittsburgh, Pa.

[21] Appl. No.: 927,269

[22] Filed: Jul. 21, 1978

[51] Int. Cl.[2] ..... C25B 1/00

[52] U.S. Cl. ..... 204/101

[58] Field of Search ..... 204/59 R, 99, 101, 103; 423/333, 338, 339

[56] References Cited

U.S. PATENT DOCUMENTS

| | | | |
|---|---|---|---|
| 1,132,394 | 3/1915 | Schwerin | 204/103 |
| 1,562,940 | 11/1925 | Collins | 204/103 |
| 3,256,068 | 6/1966 | Burke, Jr. et al. | 23/285 |
| 3,281,210 | 10/1966 | Burke, Jr. et al. | 23/182 |
| 3,307,906 | 3/1967 | Burke, Jr. | 23/182 |
| 3,325,249 | 6/1967 | Burke, Jr. et al. | 23/182 |
| 3,372,046 | 3/1968 | Burke, Jr. | 106/288 |
| 3,383,172 | 5/1968 | Biegler | 23/182 |
| 3,401,017 | 9/1968 | Burke, Jr. | 23/182 |
| 3,455,718 | 7/1969 | Dithmar et al. | 106/287 |
| 3,511,605 | 5/1970 | Smith et al. | 23/182 |
| 3,533,816 | 10/1970 | Oken | 106/74 |
| 3,649,189 | 3/1972 | Kugler et al. | 23/182 V |
| 3,668,088 | 6/1972 | Iler | 204/101 |

OTHER PUBLICATIONS

Soluble Silicates, Their Properties and Uses, by James G. Vail (1952), pp. 95–98.

Trans. Faraday Soc., 31 (1935), pp. 297–304.

*Primary Examiner*—T. M. Tufariello

*Attorney, Agent, or Firm*—Robert J. Grassi

[57] ABSTRACT

Novel silica gels are disclosed, as well as their formation from aqueous sodium silicate solutions by neutralizing the hydroxyl ion by electrolysis at a rate whereby the concentration of hydroxide ion is maintained within the range wherein silica gel forms.

5 Claims, 1 Drawing Figure

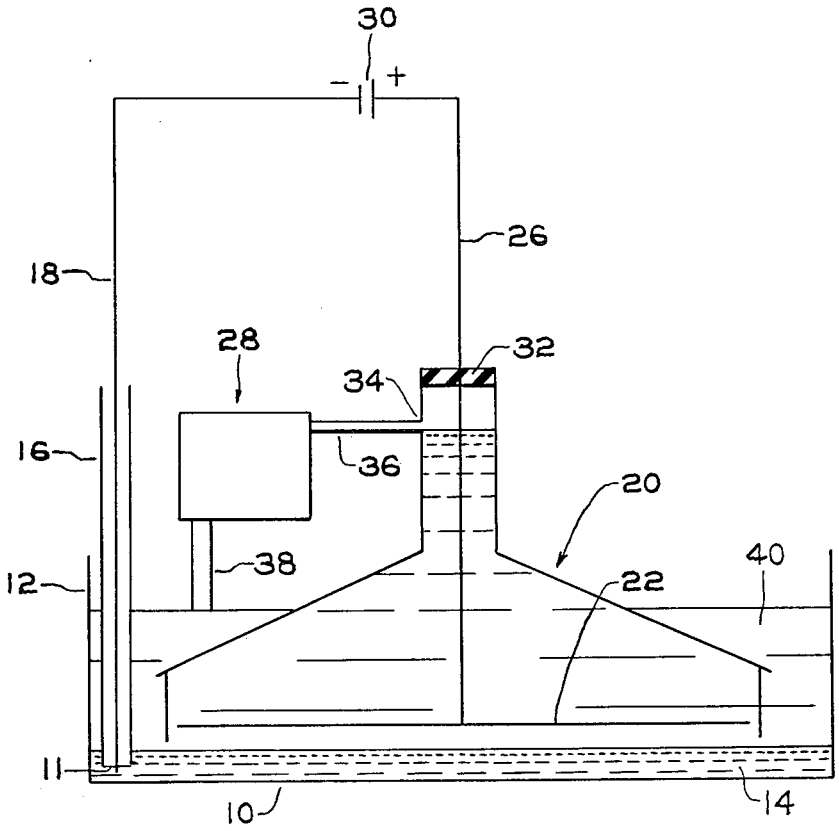
30
−
+
26
18
28
32
34
16
36
20
38
40
12
22
11
10
14

SILICA GELS AND THEIR FORMATION BY ELECTROLYSIS OF SILICATE SOLUTIONS

BACKGROUND OF THE INVENTION

1. Field of the Invention

The invention pertains to novel silica gels and the method of preparing the silica gels by neutralizing hydroxide ions by electrolysis at a rate whereby silica gel forms.

2. Description of the Prior Art

The prior art processes for forming silica gel are by removal of the hydroxyl ion by acidification with acid solutions. Examples of which are U.S. Pat. Nos. 3,256,068, 3,281,210, 3,325,249, 3,307,906, 3,372,046, and 3,401,017.

Other methods include defluorinating pigmentary silica (U.S. Pat. No. 3,511,605), removing the alkali metal anion with a certain exchange resin (U.S. Pat. No. 3,533,816), burning coarse particles of silica oxide, or vaporizing silicate solutions in an arc (U.S. Pat. Nos. 3,649,189, 3,383,172, and 3,455,718), and electrodialyzing silicates (U.S. Pat. No. 3,668,088).

The art also describes forming chemically pure soluble silicic acid by electrolysis (U.S. Pat. No. 1,132,394), but not silica gels. The art describes formation of pure silica sols by electrolysis of sodium silicate solution between a rotating platinum anode and a flowing mercury cathode from which the sodium produced by electrolysis is continuously removed. This is described in *Soluble Silicates, Their Properties and Uses,* Vol. 1, Chemistry by James G. Vail, American Chemical Society, Monograph Series-Book Division, Reinhold Publishing Corporation, New York 36, U.S.A. (1952), page 96.

The prior art also describes an electrolytic process for preparing a solution of a highly siliceous ratio from ordinary commercial water glass. [Codd, L. W., British Pat. No. 206,752 (1923), Codd, L. W., U.S. Pat. No. 1,557,491 (1925), Collins, N. L., U.S. Pat. No. 1,562,940 (1925), and Frieth et al, U.S. Pat. No. 1,541,699 (1925)]

None of the references, however, teach or suggest formation of a silica gel, as described herein.

BRIEF DESCRIPTION OF THE DRAWING

FIG. 1 is a cross-sectional view of a mercury cathode electrolytic cell used in the process of forming silica gel.

SUMMARY OF THE INVENTION

The invention concerns novel silica gels having the properties described herein. The silica gels are produced from aqueous silicate solutions containing hydroxyl ions by neutralizing the hydroxyl ions by electrolysis under conditions which maintain the concentration of hydroxyl ions within the range whereby silicate ions polymerize to form a silica gel and collecting the silica gel. Preferably the hydroxyl ions are neutralized in an electrolytic cell having an anode adapted both to remove the hydroxyl anions and to collect the silica gel formed.

DETAILED DESCRIPTION OF THE INVENTION

The process disclosed herein for producing silica gel from silicate solutions containing hydroxyl ions comprises the following steps: (1) neutralizing the hydroxyl ion by electrolysis under those conditions which maintain the concentration of the hydroxyl ion within the range whereby silicate ions polymerize to form silica gel, and (2) collecting the silica gel.

As used herein and in the claims, the phrase "neutralizing the hydroxyl ion by electrolysis" means removing the hydroxyl ions by any electrochemical mechanism in which hydroxyl ions are maintained within the concentration range whereby silicate ions polymerize to form a silica gel. Examples of such mechanisms are by removing the electrons directly from the hydroxyl ions at the anode surface to form oxygen molecules or by removing electrons from water molecules at the anode surface so as to form oxygen molecules and protons (hydrogen ions) which combine with hydroxyl ions to form water and thereby remove the hydroxyl ions from the solution or by both mechanisms ocurring concurrently or subsequent to each other at the anode.

Preferably the neutralizing of the hydroxyl ions by electrolysis occurs within an electrolytic cell which has an anode adapted to remove the hydroxyl ions and to collect the silica gel formed. The neutralizing of the hydroxyl ions by electrolysis comprises placing the silicate solution containing the hydroxyl ions within the electrolytic cell and removing the hydroxyl ions at a rate whereby the hydroxyl ion concentration within the effective vicinity of the anode is maintained within the range wherein silicate ions polymerize to form silica gel which collects upon the anode.

Preferably the silicate solution is an aqueous sodium silicate solution containing from 50 to 390 grams per liter of silicon dioxide ($SiO_2$) and from 20 to 100 grams per liter of sodium oxide ($Na_2O$). The preferred electrolysis rate for removing the hydroxide ion is at a current density of from 30 to 500 amps per square foot of anode surface (ASF). The term "square foot of anode surface" as used herein and in the claims refers to that surface accessible to the solution as determined from measurements of the outer boundaries enclosing said surface, the percent open area, and electrode active surface.

In one embodiment, the method of collecting the silica gel is by removing from the silicate solution the section of the anode having a coating of silica gel thereon, drying the coating of silica gel until the gel particles become loosely attached to the anode section, and sweeping off the particles of the loosely attached gel into a collector, such as a bag or container.

EXAMPLES OF THE INVENTION

The following experiments illustrate the process and the silica gel product described herein.

EXAMPLE I a. Description Of The Electrolytic Cell

An electrolytic cell, shown in FIG. 1, was assembled. The cell (10) was comprised of a fused silica tray (12) of 10 inches×11 inches×2.5 inches. The tray (12) was filled with about a ½ inch of mercury (14). A sealed glass tube (16) having a conductive wire (18) sealed into the tube (16) and protruding from the tube bottom (11) was immersed in the mercury (14) so as to provide an electrical conductive path thereto. Within the tray (12) was another glass box (20) constructed of PLEXIGLASS® (thermoplastic poly) methyl methacrylate-type polymer in cast sheet, and located (approximately 0.75 inch) above the larger of mercury (14). Within the glass box (20) was an anode (22) formed of titanium mesh coated with 97.5 percent platinum and 2.5 percent rhodium and with outer dimensions of 6 inches×8 inches and a total surface area of 48 square inches*. (The silica gel forms upon this coated mesh.) The anode (22) was placed within the center of the box above the mercury (14) and connected to a conductive holder (a titanium bar (26)). The glass box (20) had connected there to a pump (28) with its inlet (36) connected to the outlet (34) of the glass box (20). The outlet (38) of the pump (28) was placed in the silicate solution (40). The pump was a Master Flex pump No. 7017. The glass box (20) provides a means for flowing the silicate solution (40) within the cell between the titanium anode (22) and the mercury layer (14). The titanium anode (22) through its conductive holder (26) and the mercury (14) through the conducting wire (18) were connected to a direct current (DC) supply (30). The current supply means was a rectifier, but other means adapted for adjustments of voltage and current output with time may also be used. The cathode assembly consisted of the layer of mercury (14) and its conductive wire (18) sealed in the glass tube (16). The cell (10) was filled with 18 pounds (approximately 8.2 kilograms) of mercury (14) and after insertion of the glass tube (16) and wire (18), it was filled with 2.5 liters of a sodium silicate solution containing 39 grams per liter of sodium oxide ($Na_2O$) and 120 grams per liter of silicon dioxide ($SiO_2$).

*50 percent open area, both sides active so SA = 6 inches×8 inches = 48 square inches b. Description Of The Electrolysis Process The titanium mesh anode (22) was placed in the glass box (20) and sealed at the top (32) of the glass box as shown in FIG. 1 with a rubber stopper (33). The glass box (20) was lowered into the silicate solution and positioned over the mercury layer so that the titanium anode (22) was located approximately 1.5 inches above the mercury surface. The outlet (34) of the box (20) was connected to the pump inlet (36) and the pump outlet (38) was positioned within the sodium silicate solution so as to allow the silicate solution to be pumped into the solution without causing excessive bubbling. The pump (28) was turned on and the flow rate of the sodium silicate solution through the pump was adjusted to 1.85 liters per minute.

The power was turned on and maintained at 13 amps (30 ASF), the initial voltage was 5.12 V. After ten (10) minutes the voltage was 5.6 V; at the end of 20 minutes the voltage was 5.73 V; at the end of 30 minutes the voltage was 5.88 V; at the end of 42 minutes the voltage was 6.2 V; at the end of 50 minutes the voltage was 6.59 V; at the end of 60 minutes the voltage was 7.38 V; at the end of 70 minutes the voltage was 8.43 V; at the end of 80 minutes the voltage was 9.09 V; and at the end of 90 minutes the voltage was 9.54 V when the power was turned off.

The cell was dismantled and the anode was washed and allowed to air dry over the weekend. After drying, the silica gel was brushed off and collected. The amount of silica gel obtained under these conditions was 35.2 grams and contained 11.5 percent water.

The silica gel was then hammer milled through 0.010 inch screen and submitted for X-ray analysis, pH measurements, water absorption measurements, and surface area measurements by the BET method (See Brunaer, Emmett, and Teller, *Journal of American Chemical Society*, 60, (1938), page 309). X-ray analysis of the silica gel was by X-ray Fluoresence Analysis without Internal Standard (alternative methods, page 6) described in *Norelco Reporter*, Volume III, No. 1, January–February 1957, pages 3–8, published by Phillips Electronics, Inc., Mount Vernon, NY. The X-ray analysis (as Example I) is shown in Table 1 and the other physical properties of the silica gel are shown in Table 2 (as Example I). As used herein and in the Claims, the phrase "X-ray analysis" refers to that method of X-ray analysis described above.

EXAMPLE II

Sodium silicate solution (2.3 liters) containing 40.4 grams per liter of sodium oxide ($Na_2O$) and 126 grams per liter of silicon dioxide ($SiO_2$) and 18 pounds of mercury were placed in the tray, with the titanium anode placed about ½ inch above the mercury. The silicate recirculation rate was adjusted to flow at about 80 milliliters per minute past the anode surface. The current was 33 amps (100 ASF) with the initial voltage at 8.3 V which was adjusted to maintain this amperage for 30 minutes. At the end of 30 minutes, the voltage was 11.3 V. The power was shut off and the silica gel, having 65 percent solids, was air dried. The silica gel contained 55 grams of silicon dioxide ($SiO_2$).

The cell was dismantled, the mercury cleaned, and 1.7 liters of the fresh silicate containing 40 grams per liter of sodium oxide ($Na_2O$) and about 126 grams of silicon dioxide ($SiO_2$) were added to the tray and electrolysis started. The initial voltage was 7.1 V, the current was 33 amps (100 ASF), the flow was 80 milliliters per minute, and the electrode gap between the mercury and titanium anode was ½ inch. After 15 minutes the voltage was 9.1 V and the amount of sodium oxide ($Na_2O$) in the solution was 36.5 grams per liter. At the end of 30 minutes the voltage had climbed to 10.8 V and the power was turned off. The silicate solution had depleted to 32.3 grams per liter of sodium oxide ($Na_2O$). The amount of silica gel was 43.6 grams of silicon dioxide ($SiO_2$) and it contained 62 percent solids. These two samples were combined, air milled, screened, and then sent for X-ray analysis, BET measurements, pH measurements, and water absorption measurements as in Example I. The results are given in Tables 1 and 2 as Example II.

Other experiments were carried out using an iron cathode in a different cell construction. These examples were conducted at 100 to 110 amps per square foot (ASF). The results from analysis of these examples are shown in Table 1 for X-ray analysis and Table 2 for physical properties as Examples III and IV.

Table3 illustrates the silica gel yields under different conditions of anode current density, and silicon dioxide ($SiO_2$) concentration.

TABLE 1

X-RAY ANALYSIS OF THE SILICA GEL FORMED BY ELECTROLYSIS

| Elements | Example I Hg Cathode | Example II[2] Hg Cathode | Example III Fe Cathode | Example IV Fe Cathode | Commercial Gel[1] |
|---|---|---|---|---|---|
| NaCl | 0.21 | 0.15 | 0.14 | 0.11 | <0.01 |
| $SO_3$ | 0.12 | 0.12 | 0.17 | 0.11 | 0.05 |
| $ZrO_2$ | 0.038 | 0.093 | 0.098 | 0.094 | 0.056 |
| $Fe_2O_3$ | 0.02 | 0.11 | 0.22 | 0.12 | 0.027 |

TABLE 1-continued

X-RAY ANALYSIS OF THE SILICA GEL FORMED BY ELECTROLYSIS

| Elements | Example I Hg Cathode | Example II[2] Hg Cathode | Example III Fe Cathode | Example IV Fe Cathode | Commercial Gel[1] |
|---|---|---|---|---|---|
| Mn | 0.0010 | 0.0010 | 0.0015 | 0.0011 | 0.0003 |
| $TiO_2$ | 0.062 | 0.058 | 0.059 | 0.059 | 0.028 |
| CaO | 0.02 | 0.02 | 0.06 | 0.01 | <0.01 |
| $Al_2O_3$ | 0.42 | 0.37 | 0.37 | 0.39 | 0.03 |
| MgO | 0.02 | 0.02 | 0.18 | 0.02 | 0.01 |
| $Na_2O$ | 0.72 | 0.85 | 1.46 | 0.83 | <0.01 |
| LOI | 17.20 | 16.49 | 15.77 | 15.31 | 11.89 |
| $SiO_2$ | 81.28 | 81.87 | 81.61 | 83.06 | 87.91 |

[1]Commercial silica gel Grade 05 from Fisher, hammermilled and micronized the same as the experimental gels.
[2]A spectrographic scan of 451-603 showed no Hg to be present.

TABLE 2

PHYSICAL PROPERTIES OF SILICA GELS

| Sample | pH (5 g. in 95 g. $H_2O$) | BET $M^2/g$. | $H_2O$ Absorption In 90% Relative Humidity |
|---|---|---|---|
| Example I | — | 479 | — |
| Example II | 7.4 | 497 | 22.84 |
| Example III | 7.9 | 328 | 16.2 |
| Example IV | 7.4 | 443 | 20.72 |
| Commercial Gel[1] | 3.7 | 717 | 21.75 |
| Syloid 63 | — | 303 | 10.98 |

[1]Commercial desiccant gel Grade 05 from Fisher Scientific

TABLE 3

SILICA YIELDS FROM DIFFERENT ELECTROLYZING CONDITIONS[1]

| Cathode | $SiO_2$ Conc g/l | Current ASF | Volts Initial | Volts Max. | Time Of Run Minutes | Dry $SiO_2$ Deposit $g/ft^2$ of Anode Surface | % Solids In Wet Gel |
|---|---|---|---|---|---|---|---|
| Iron | 126 | 100 | 6.5 | 11.0 | 30 | 147.6 | 69.2 |
| Iron | 189 | 100 | 8.0 | 17.0 | 30 | 203.9 | 68.4 |
| Mercury | 120 | 30 | 5.1 | 9.5 | 90 | 93.5 | — |
| Mercury | 126 | 100 | 8.0 | 12.0 | 30 | 148.0 | 63.0 |

[1]All numbers are averages of several runs at the same conditions

ELECTROLYTIC CONDITIONS a. Characteristics Of The Silicate Solution

As those skilled in the art would know, the electrolysis conditions can be varied. For example, the amount of sodium oxide ($Na_2O$) within the solution may vary from 20 to 100 grams per liter, but preferably is from 40 to 100, and highly preferred is from 60 to 100. The amount of silicon dioxide ($SiO_2$) may vary from 50 to 390 grams per liter, but preferably it is from 100 to 350, and from 220 to 330 is especially preferred. The general ratio of $SiO_2/Na_2O$ is from 2.00 to 4.00 with the range 2.5 to 3.3 being preferred to obtain a high solids content (about 54 to 58 percent solids in vehicle) of silica gel. For the optimum conditions of high surface area, from 356 to 495 square meters per gram, the $SiO_2/Na_2O$ ratio is from 2.88 to 4.00 and the viscosity of the solution may be up to 500 centipoises. Generally, 300 centiposes is maximum but the preferred range is from 100 to 225 centipoises. The rate of removal of the hydroxyl ion may be from 30 amps per square foot to 500 amps per square foot but preferred is a rate from 75 amps to 450 amps per square foot, and especially preferred is a rate from 100 amps per square foot to 300 amps per square foot. The rate of flow of the silicate solution past the anode surface is adjusted so as to maintain the maximum moles of $SiO_2$ deposited per Faraday of current. This adjusted rate would, of course, depend upon the rate at which the hydroxide ions are being removed and the silica gel being formed, and the gap between the surfaces of the anode and the cathode.

b. Electrolysis Rate

As used herein and in the claims, the phrase "neutralizing the hydroxyl ions at the anode of the electrolytic cell at a rate whereby the hydroxyl ions concentration within the effective vicinity of the anode is maintained within the range whereby silicate ions polymerize to silica gel" refers to those conditions wherein the current density rate is within the range mentioned herein. The "effective vicinity of the anode", as those skilled in the art know, varies with the cell design, and refers to that volume of anode compartment wherein the current density and throwing power of the solution affect the removal of the hydroxyl ions. The current density and throwing power depends upon the viscosity of the solution, the flow of solution past the anode surface or the rate at which hydroxyl ions moves in and out of the anode as well as other factors which affect the removal of hydroxyl ions, all of which factors affect the hydroxyl ion concentration so as to cause polymerizing of the silicate ions into silica gel. The pH of the solution will automatically adjust itself under these conditions so that the current density and voltage values at which the silica gel will polymerize is shown, for example, by Examples I and II and as described herein. The term "an anode" as used herein and in the claims, refers to any assembly which provides an anode surface and means for transferring electrons from the silicate solution in contact with the anode surface to a current supply means.

c. Types Of Electrolytic Cells

The electrolytic cell described herein is not necessarily the only cell to use. For example, the cell itself can be constructed so that the anode and cathode are in a vertical position and the solution in the anode compartment (anolyte) and cathode compartment (catholyte) are separated from each other by a separator such as a polypropylene fiber, or other material known in the art to be useful in other aqueous electrolytic processes. The separator merely serves to prevent the passage of gases, such as hydrogen, into the anode compartment or oxygen into the cathode compartment, to prevent hydrogen and oxygen from reacting and causing an explosion. Furthermore, such a cell would be constructed with vents to provide the withdrawal of the hydrogen and oxygen as it is formed. The mercury cell described herein in Example I, did not require a separator because the cathode reaction is $$Na^+ + e^- \xrightarrow{Hg} Na(Hg)_x,$$

but in cells using cathodes such as steel, graphite, nickel, and others known in the prior art have as the cathode reaction the formation of hydrogen gas.

The term "anode" as used herein and in the claims, also refers to anodes wherein there would be connected to the conductive surface a matte of a polymeric material which is compatible with permitting the silicate solution to flow to the surface of the anode. One example is a polypropylene fiber matte. The silica gel within is in the vicinity of the anode, e.g., within the spaces of the matte, or at its surface, forms, collects upon and within the matte, and the matte is removed and dried, and the silica gel is then removed therefrom.

In another embodiment, the matte is constructed to move across or over the surface of the anode at a rate whereby at a constant current density and electrolyte flow the voltage remains constant for a much longer period of time and the efficiency of depositing the polymerized silica gel in the fiber matte is high, such as from 50 to 100 percent. Thus the term "anode" as referred to herein refers to such an assembly of the anode and such a matte. Furthermore, the phrase "the section of the anode upon which the silica forms" as used herein and in the claims refers to, for example, the polypropylene matte, as well as when the matte is not used, and refers to that section of the anode immersed in the silicate solution, and upon which the silica gel forms.

As those skilled in the art easily recognize, the anode need not be of titanium coated with platinum and rhodium as in Example I. It can be coated with other materials or it can be made of different materials. Such anodes, for example, that are used in the electrolysis of brine solutions or in the electrolysis of water may be used. Likewise the cathode need not be of mercury but can be of iron or it can be of other materials which are known in the art to give low over voltages. The selection of the material would be such as to maintain the efficiency of the cell as high as possible.

The cell is constructed in such a way that the flow rate of the silicate maintains the migrations of the ions at a maximum to permit uniform deposition. Those skilled in the art are well aware of the requirements for proper cell construction as set forth, for example, in a textbook such as the *Introduction to Electro-Chemistry,* by Gladstone, published by D. Van Nostrum Co. and periodically updated.

The flow rate of the silicate is adjusted so as to maintain the concentration of the sodium solution in the effective vicinity of the anode as constant as possible so that the voltage drop through the cell is maintained as low as possible while maintaining the correct hydroxyl concentration in the effective vicinity of the anode.

d. Composition Of The Silica Gel

The composition of the silica gel formed by the process are novel and differ from those made by other processes and varies with the electrolysis conditions. The compositions comprise, based on the method of X-ray analysis as described herein, from 81 to 84 percent silicon dioxide ($SiO_2$) and the sodium oxide ($Na_2O$) content would be from about 0.72 percent to 1.50 percent without any washing steps or purification steps, as with ion exchange columns, etc. The surface area of the silica gel formed herein would vary from about 325 square meters per gram to about 725 square meters per gram. The pH of such a silica gel, which is determined by the addition of 5 grams of the dried silica gel in 95 grams of water and measured at a temperature of from 14 to 22° Centigrade, varies from about 3.0 to 9.0. Furthermore, the amount of water absorbed by the silica gel formed by the process defined herein varies from 16.0 to 22.0 percent by weight of the silica gel at 90 percent relative humidity. The silica gel can also further contain the other elements such as sodium chloride, zirconium oxide, ferric oxide, magnesium oxide, titanium oxide, and aluminum oxide as shown in the X-ray analysis of Table 1, within the range as shown therein.

While the invention has been described with reference to specific details of certain illustrative embodiments, it is not intended that it shall be limited thereby except insofar as such details appear in the accompanying claims.

We claim:

1. A process for producing silica gel upon an anode from a silicate solution containing hydroxyl ions which comprises:

neutralizing the hydroxyl ions by electrolysis at conditions which maintain the concentration of hydroxyl ions within the range whereby silicate ions polymerize to form a silica gel by placing the silicate solution containing hydroxyl ions within an electrolytic cell in the vicinity of an anode adapted to neutralize hydroxyl ions and to collect silica gel thereon, removing the hydroxyl ions from the solution in the effective vicinity of the anode at a rate whereby the hydroxyl ion concentration within the effective vicinity of the anode is maintained at the range whereby silica ions polymerize to form a silica gel which collects upon the anode, and collecting the silica gel.

2. The process as recited in claim 1, wherein the silicate solution is an aqueous sodium silicate solution containing from 50 to 390 grams per liter of silicon dioxide ($SiO_2$) and from 20 to 100 grams per liter of sodium oxide ($Na_2O$).

3. The process as recited in claim 1, wherein the rate of removing of the hydroxyl ions in the vicinity of the anode is at a current density of from 30 amps per square foot to 500 amps per square foot of anode surface.

4. The process as recited in any of claims 1 through 3, wherein the step of collecting the silica gel comprises:

removing the section of the anode which has a coating of silica gel thereon from the silicate solution.

drying the coating of silica gel until particles of the gel become loosely attached to said anode section, and sweeping said particles of loosely attached gel into a collector.

5. A silica gel composition comprised of from 80 to 84 percent by weight of silicon dioxide ($SiO_2$) and from 0.72 to 1.50 weight percent of sodium oxide ($Na_2O$), based on X-ray analysis, and said gel has a surface area of from 300 square meters per gram to 725 square meters per gram, a water absorption at 90 percent relative humidity of from 16 percent to 22 percent, and a pH value, when 5 grams of said silica gel is placed in 95 grams of water at a temperature of from 14 to 22° Centigrade, of from 3.0 to 9.0.

* * * * *

UNITED STATES PATENT AND TRADEMARK OFFICE

CERTIFICATE OF CORRECTION

PATENT NO. : 4,193,851

DATED : March 18, 1980

INVENTOR(S) : Crawford et al.

It is certified that error appears in the above-identified patent and that said Letters Patent are hereby corrected as shown below:

Column 8, line 46, "Claim 1" should be --Claim 2--.

Column 8, line 53, "solution." should be --solution,--.

Signed and Sealed this

*Seventeenth* Day of *June 1980*

[SEAL]

*Attest:*

SIDNEY A. DIAMOND

*Attesting Officer*

*Commissioner of Patents and Trademarks*